US006041951A

United States Patent [19]

Blum et al.

[11] Patent Number: 6,041,951

[45] Date of Patent: Mar. 28, 2000

[54] NURSING BOTTLE DISPENSING ADAPTOR

[76] Inventors: Sanford Blum, 20515 E. Country Club Dr., Apartment 847, North Miami Beach, Fla. 33180; Rafael Jakubow, 465 Golden Beach Dr., North Miami, Fla. 33160

[21] Appl. No.: 09/109,525

[22] Filed: Jul. 2, 1998

[51] Int. Cl.[7] ..... A61J 9/00

[52] U.S. Cl. ..... 215/11.1; 215/388

[58] Field of Search ..... 215/11.1, 11.4, 215/11.5, 380

[56] References Cited

U.S. PATENT DOCUMENTS

| | | | |
|---|---|---|---|
| 929,990 | 8/1909 | Shields . | |
| 1,372,715 | 3/1921 | Morledge . | |
| 1,525,314 | 2/1925 | Mullen | 215/11.1 |
| 2,608,841 | 9/1952 | Rice | 65/13 |
| 2,655,279 | 10/1953 | Wolf | 215/11.1 X |
| 2,744,529 | 5/1956 | Tichy | 215/11.4 |
| 2,767,871 | 10/1956 | Shapiro | 215/11.5 |
| 2,774,518 | 12/1956 | Greene | 222/209 |
| 2,868,203 | 1/1959 | Tichy | 215/11.4 |
| 3,411,648 | 11/1968 | Tichy | 215/11.4 |
| 3,441,160 | 4/1969 | Levy | 215/11.1 |
| 3,635,380 | 1/1972 | Fitzgerald | 222/484 |
| 3,840,153 | 10/1974 | Devlin | 222/146 C |
| 4,153,170 | 5/1979 | Aquarian | 215/11.1 |
| 4,440,328 | 4/1984 | DeFrentas | 222/538 |
| 4,444,358 | 4/1984 | Spohn et al. | 239/284 |
| 4,494,668 | 1/1985 | Lottick | 220/90.4 |
| 4,557,392 | 12/1985 | Ryan et al. | 215/11.1 |
| 4,744,477 | 5/1988 | Wofford | 215/388 X |
| 4,821,895 | 4/1989 | Roskilly | 215/11.1 |
| 4,940,152 | 7/1990 | Lin | 215/11.1 |
| 5,439,125 | 8/1995 | Bloch | 215/11.1 X |
| 5,873,474 | 2/1999 | Gray | 215/11.1 |

FOREIGN PATENT DOCUMENTS

| | | | |
|---|---|---|---|
| 7001730 | 8/1971 | Netherlands | 215/11.1 |
| 1253398 | 11/1971 | United Kingdom | 215/11.4 |

*Primary Examiner*—Sue A. Weaver
*Attorney, Agent, or Firm*—Frank L. Kubler

[57] ABSTRACT

A dispensor adaptor is provided for a nursing bottle containing liquid having a bottle bottom wall joined to a tubular bottle side wall with an rim onto which is removably fitted a bottle lid having an outwardly protruding nipple structure containing a liquid passageway, the bottle lid being fastened against the upper rim and the side wall with a fastening mechanism, the adaptor including a substantially disk-shaped flange having a central port, for placement onto the upper rim when the lid is removed, and for securing within the bottle by fastening the lid onto the rim within the fastening mechanism so that the flange is retained between the lid and the rim, the flange making sealing contact with the nipple structure which circumscribes the liquid passageway, and a liquid gathering tube extending from the central port in the flange toward the bottle bottom wall and opening within the bottle to gather the liquid, so that drawing upon the nipple structure extracts a quantity of the liquid through the liquid gathering tube and the nipple structure and from the bottle.

3 Claims, 2 Drawing Sheets

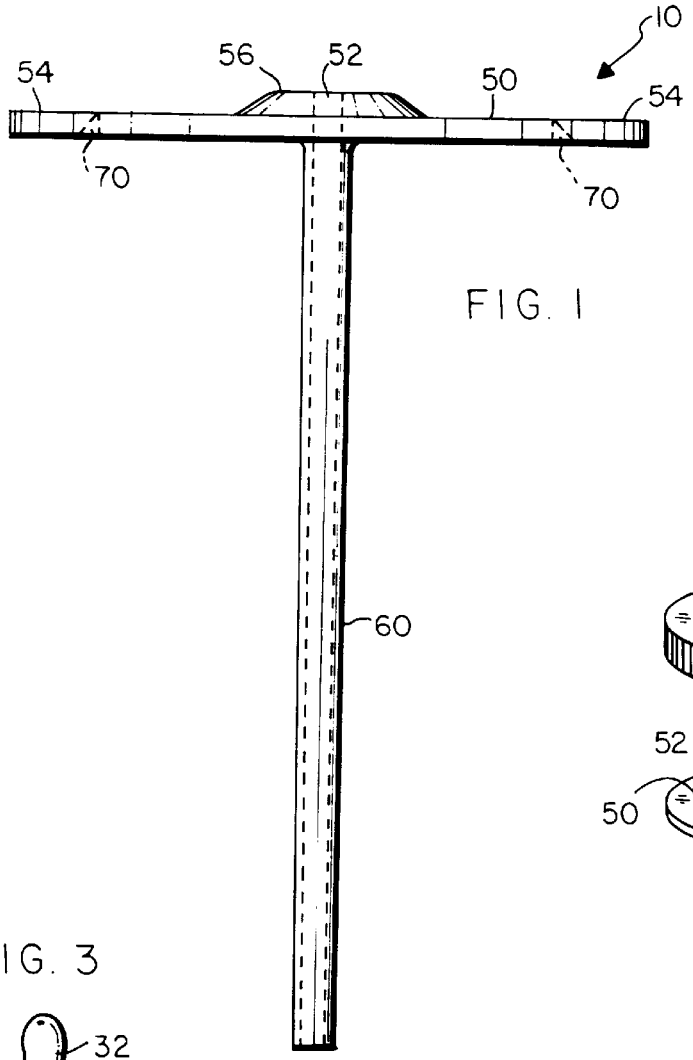
FIG. 1
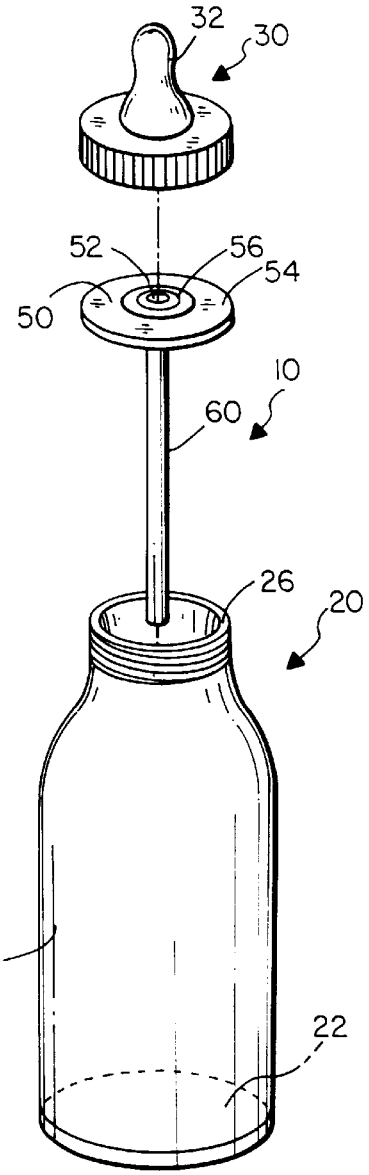
FIG. 2
FIG. 3
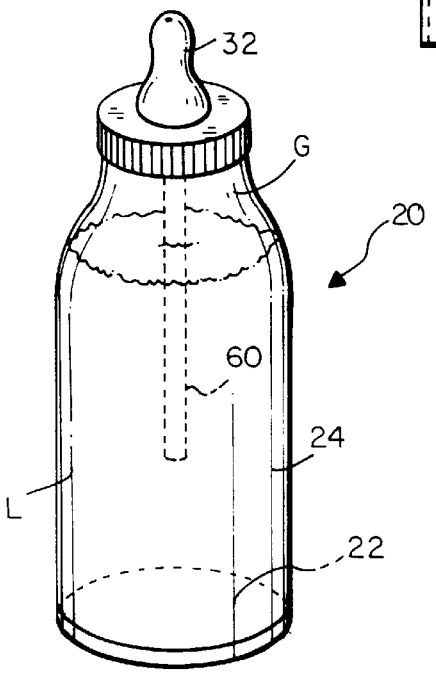

NURSING BOTTLE DISPENSING ADAPTOR

BACKGROUND OF THE INVENTION

1. Field of the Invention:

The present invention relates generally to the field of drinking vessels and accessories. More specifically the present invention relates to a dispensor adaptor for a standard nursing bottle permitting a child to draw upon the nipple and thereby extract liquid such as formula from the bottle regardless of bottle orientation.

It is understood that a standard nursing bottle has a bottle bottom wall joined to a tubular bottle side wall having an upper rim onto which is removably fitted a bottle lid having an outwardly protruding nipple. The lid is removably fastened to the rim and upper side wall with screw threads, although the invention will operate regardless of the fastening method. The inventive adaptor includes a disk-shaped flange which fits onto the upper rim when the lid is removed, and which is then secured within the bottle by fastening the lid onto the rim so that the flange is gripped between the lid and rim. A liquid gathering tube extends from a central tube port in the flange substantially along the bottle longitudinal axis toward the bottle bottom wall where it opens to gather liquid within the bottle. The central region of the flange upper surface thickens to protrude upwardly around the tube port to make sealing contact with the lower surface of the nipple structure, so that suction created within the nipple structure by a child is transmitted into the liquid gathering tube to draw up the liquid. The adaptor is preferably made entirely of the same soft, flexible and safe material used to make conventional nursing bottle nipple structures.

As a result, a child is able to extract liquid from the bottle by drawing upon the nipple, regardless of whether the bottle is angled with respect to horizontal or is wholly upright, because the tube bridges the air pocket gap which progressively forms between the nipple and the liquid upper surface as the bottle is drained.

It is preferred that the flange have an outer diameter equal to the outer diameter of the wider of the two nursing bottle rim diameters available today. So that the same apparatus is adaptable to the narrower bottle rim diameter, a stress rising groove having a sharp V-shaped cross-section extends along a circular path around the flange concentric with the outer flange diameter. The diameter of the groove path matches the outer diameter of the narrower bottle rim. As a result, the outer portion of the flange beyond the groove may be torn away along the groove to leave a smaller flange having a precisely measured and uniformly circular outer edge.

2. Description of the Prior Art

There have long been bottles with means for assisted liquid contents delivery. Several pump action bottles have been provided, yet none includes means for assisting a child in drawing liquid formula from within a nursing bottle. One such prior bottle is that of Shields, U.S. Pat. No. 929,990, issued on Aug. 3, 1909. Shields discloses a dispensing pump for a bottle and includes a stopper for sealing the bottle mouth. A liquid gathering tube passes downwardly through the stopper to the lower region of the bottle. A liquid delivery tube extends laterally from the stopper in fluid communication with the gathering tube, and a squeeze bulb is provided in fluid communication with both tubes for pumping air into the bottle through the gathering tube, for extracting liquid in the bottle through the gathering tube and for dispensing the liquid extracted through the liquid delivery tube.

Morledge, U.S. Pat. No. 1,372,715, issued on Mar. 29, 1921, reveals a milk bottle stopper. Morledge includes a squeeze bulb having an external surface shaped to partially enter and make sealing contact with the open top of a bottle, an air release port in the lower wall of the bulb, and an air entry port with a check valve in the bulb side wall. A beverage delivery tube passes through a thick corner of the bulb into the beverage. To dispense the beverage, the user presses down on the bulb so that air within the bulb is forced into the bottle above the beverage where it is compressed. The compressed air drives some of the beverage out of the bottle through the delivery tube. The bulb resiliently resumes its original shape and the expelled air is replaced by intake through the check valve.

Rice, U.S. Pat. No. 2,608,841, issued on Sep. 2, 1952, teaches a drinking cup for use by infants and invalids. Rice includes a drinking cup having a lid removably and sealingly fitting onto the cup open top, the lid having an outwardly protruding integral drinking tube formed into one side and an air admission valve formed into the opposing side. The air admission valve includes a dial having downwardly opening radial ports which can be partly or wholly aligned with lid ports beneath the dial, so that the rate of air entry can be adjusted to permit a like rate of beverage discharge.

Greene, U.S. Pat. No. 2,774,518, issued on Dec. 18, 1956, discloses a moldable cone bellows. The bellows is part of a bottle lid having lid screw threads within a lid side wall portion for sealingly fastening the lid onto a bottle, the top of the lid having a flexible, stepped bellows protruding upwardly therefrom, and a beverage gathering tube extending down from the top of the bellows into the lower end of the bottle. A dispensing tube in fluid communication with the gathering tube extends laterally from the top of the bellows. To use the apparatus, the one presses down on the bellows and therey creates increased air pressure above the beverage within the bottle. This increased pressure forces some of the beverage to exit the bottle through the gathering and discharge tubes. A very narrow intake passageway in the bellows permits air entry to fill the volume left by expelled liquid.

Roskilly, U.S. Pat. No. 4,821,895, issued on Apr. 18, 1989, reveals a nursing bottle accessory having means for the introduction of a separate substance such as a medicine into the bottle. Roskilly includes a nursing bottle with a bottle lid having a solid lid body portion between the lid side walls, the body portion being laterally offset from the bottle vertical axis. A laterally angled first lid port extends up through the lid body portion into a conventional nipple structure to dispense liquid formula. A second lid port angles from the nipple structure laterally to open out of the side of the lid body portion, and a syringe is externally fitted into this second lid port. A measured quantity of medicine is placed in the syringe, and the syringe is operated to discharge the medicine through the second lid port into the formula in the bottle.

Spohn, et al., U.S. Pat. No. 4,444,358, issued on Apr. 24, 1984, teaches a bottle having an electrically powered pump in its lower end and insulated wiring and delivery tubes extending down through the bottle mouth to the pump. A plug is secured in the mouth of the bottle which holds the delivery tube and wiring in place. Spohn, et al., is intended as a windshield washer fluid supply, and also teaches a mounting bracket and clip for retaining the bottle in a vehicle.

De Freitas, U.S. Pat. No. 4,440,328, issued on Apr. 3, 1984, reveals a wide-mouthed isothermal container with an integrated handle equipped with an immersed pump. The pump is push-button activated and fluid is delivered out of the container through a spout structure which is first rotated outwardly to a dispensing position.

Fitzgerald, U.S. Pat. No. 3,635,380, issued on Jan. 18, 1972, discloses a container closure for a traveler which prevents spilling. Fitzgerald includes a closure for a drinking receptacle having several valve closed air intake and fluid discharge openings actuable by pressure on the closure to open the closed valves. An appropriate drinking mouthpiece and air vent hose are fitted to the discharge openings.

Devlin, U.S. Pat. No. 3,840,153, issued on Oct. 8, 1974 discloses a drinking vessel with a refrigerant capsule. Devlin includes a container having flexible walls and a conduit extending into the container. The container has flexible walls to which pressure is manually applied and has a valve in the conduit to control the flow of a beverage which is dispensed during pressure application. A capsule that contains a refrigerant is insertable into the container to keep the liquid contents of the container cool. The Devlin vessel may be secured to a bicycle to hold refreshment for the rider.

Lottick, U.S. Pat. No. 4,494,668, issued on Jan. 22, 1985, teaches a stackable, non-spillable drinking container. The container has a linearly increasing cross-section and an open mouth at its larger end and a closed bottom at or near the smaller end. A base plate is provided with an expandable diaphragm mounted over substantially one surface of the base plate. The expandable diaphragm is provided with perforations which are normally closed in the unexpanded state of the diaphragm and which are open when the expandable diaphragm is stretched by movement of the central portion of the diaphragm away from the surface of the base plate. The expandable diaphragm includes means for attachment to a drinking tube. A top of the container is securably mountable over the open mouth of the container.

It is thus an object of the present invention to provide an apparatus for installation on a conventional nursing bottle which permits a nursing child to draw liquid formula from the bottle through the nipple structure when an air space is present between the formula and the bottle lid by bridging the air gap.

It is another object of the present invention to provide such an apparatus which is adaptable for installation on either of the two standard mouth diameters of nursing bottles.

It is still another object of the present invention to provide such an apparatus which does not protrude outside the bottle, so that the child is not disturbed by a different bottle appearance.

It is finally an object of the present invention to provide such an apparatus which is easily installed and removed, is reliable, is inexpensive to manufacture and is entirely safe for infant use.

SUMMARY OF THE INVENTION

The present invention accomplishes the above-stated objectives, as well as others, as may be determined by a fair reading and interpretation of the entire specification.

A dispensor adaptor is provided for a nursing bottle containing liquid having a bottle bottom wall joined to a tubular bottle side wall with an rim onto which is removably fitted a bottle lid having an outwardly protruding nipple structure containing a liquid passageway, the bottle lid being fastened against the upper rim and the side wall with a fastening mechanism, the adaptor including a substantially disk-shaped flange having a central port, for placement onto the upper rim when the lid is removed, and for securing within the bottle by fastening the lid onto the rim within the fastening mechanism so that the flange is retained between the lid and the rim, the flange making sealing contact with the nipple structure which circumscribes the liquid passageway, and a liquid gathering tube extending from the central port in the flange toward the bottle bottom wall and opening within the bottle to gather the liquid, so that drawing upon the nipple structure extracts a quantity of the liquid through the liquid gathering tube and the nipple structure and from the bottle.

The flange preferably has an upper surface and an annular central region of the upper surface preferably protrudes upwardly around the central port to make sealing contact with the nipple structure, so that suction created by a child drawing upon the nipple structure is transmitted into the liquid gathering tube to draw the liquid through the liquid gathering tube into the nipple structure.

The nursing bottle described above is preferably the wider of two of such nursing bottles, and in this instance the adaptor preferably has an outer diameter equal to the outer diameter of the rim of the wider of the two nursing bottles, and the adaptor is adaptable to fit the diameter of the rim of the narrower of the two nursing bottles, the adaptor including a stress rising groove extending along a circular groove path around and spaced outwardly from the central port to define a flange outer portion, where the diameter of the groove path matches the outer rim diameter of the narrower nursing bottle, so that the groove severs by tearing by a user for removal of the flange outer portion beyond the groove to leave the flange with a smaller diameter matching the outer diameter of the rim of the narrower bottle. The liquid gathering tube optionally includes an expanded segment having substantially the configuration of a bellows.

BRIEF DESCRIPTION OF THE DRAWINGS

Various other objects, advantages, and features of the invention will become apparent to those skilled in the art from the following discussion taken in conjunction with the following drawings, in which:

FIG. 1 is a side view of the inventive nursing bottle dispensor adaptor.

FIG. 2 is a perspective, exploded view of a bottle, the adaptor positioned over the bottle rim and the bottle lid above the adaptor.

FIG. 3 is a perspective view of the assembled bottle and adaptor in an upright position, where the bottle contains liquid and there is an air gap above the liquid which is bridged by the liquid gathering tube.

DETAILED DESCRIPTION OF THE PREFERRED EMBODIMENTS

Figure 4:
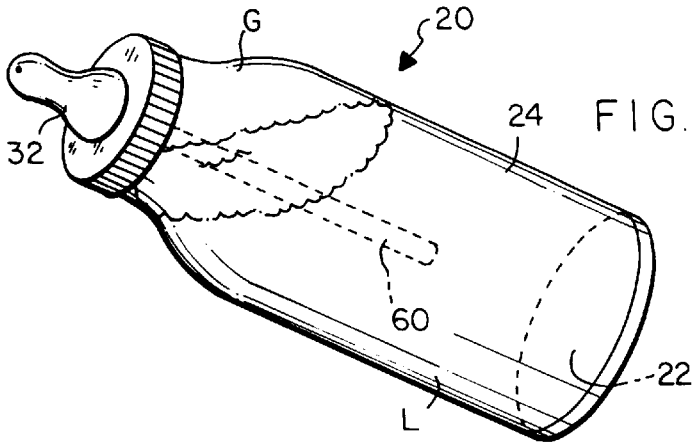
FIG. 4 is a view as in FIG. 3, with the bottle tilted, showing how the liquid gathering tube still bridges the air gap.
Figure 5:
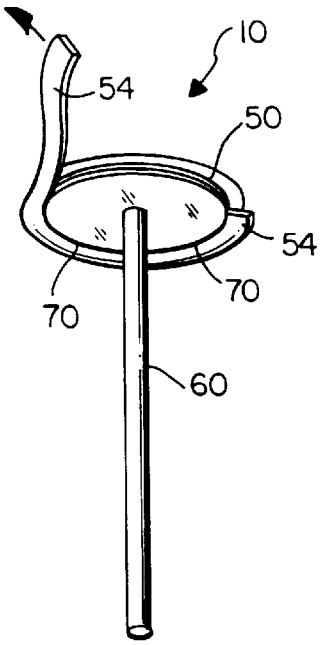
FIG. 5 is a perspective bottom view of the adaptor, with the outer portion being torn away along the stress riser groove to make the flange outer diameter smaller to fit onto the rim of the smaller standard nursing bottle.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–6, a dispenser adaptor 10 is disclosed for a standard nursing bottle 20 having a bottle bottom wall 22 joined to a tubular bottle side wall 24 having an upper rim 26. An annular bottle lid 30 having an outwardly protruding nipple 32. The lid 30 is conventionally fastened against rim 26 and to the upper portion of side wall 24 with mating screw threads on lid 30 and side wall 24, although adaptor 10 operates regardless of the type of fastener. Adaptor 10 includes a disk-shaped flange 50 which fits onto upper rim 26 when lid 30 is removed, and which is then secured within bottle 20 by fastening lid 30 onto bottle 20 and against rim 26 so that flange 50 is gripped between lid 30 and rim 26. A liquid gathering tube 60 extends from a central port 52 in flange 50 substantially along the bottle 20 longitudinal axis toward the bottle bottom wall 22 where it opens to gather liquid L within bottle 20. The central region 56 of the flange 50 upper surface protrudes upwardly around central port 52 to make sealing contact with the annular lower surface of nipple structure 32. As a result, suction created by a child within nipple structure 32 is transmitted into liquid gathering tube 60 to draw up the liquid L. Adaptor 10 preferably is made entirely of the same soft, flexible and safe material used to make conventional nursing bottle nipple structures.

A child is able to extract liquid L from a bottle 20 equipped with flange 10 by drawing upon the nipple 32, regardless of whether bottle 20 is angled wrath respect to horizontal or is wholly upright. See FIGS. 3 and 4. This is because tube 60 bridges any air pocket forming a gap G between the nipple 32 and the liquid L surface within bottle 20.

It is preferred that the flange 50 have an outer diameter equal to the outer diameter of the wider of two nursing bottle rim 26 diameters available today. A stress rising groove 70 having a sharp V-shaped cross-section preferably extends along a circular path around the lower (or upper) surface of flange 50, so that the same adaptor 10 is adaptable to the narrower diameter bottle rim 26. See FIG. 1. The diameter of groove 70 path matches the outer diameter of the narrower bottle rim 26. As a result, the outer portion 54 of the flange 50 beyond groove 70 may be torn away along groove 70 to leave a smaller flange 50 having a precisely measured and uniformly circular outer edge. See FIG. 5.

Figure 6:
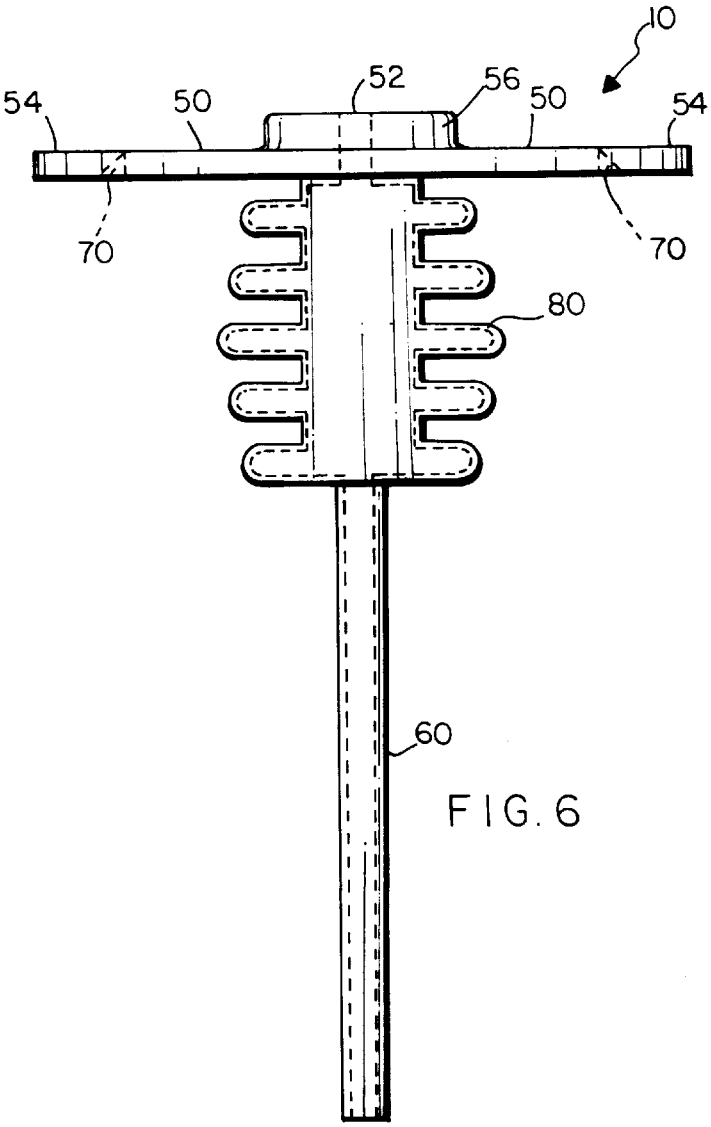
FIG. 6 is a view as in FIG. 1 of a variation of the preferred embodiment, in which the liquid gathering tube has a hollow bellows segment adjacent to the flange. The bellows segment is partly ornamental, yet it also functions to assist the user in centering the flange on the bottle rim prior to bottle lid fastening.

FIG. 6 shows a variation of the preferred embodiment, in which liquid gathering tube 60 has a hollow bellows segment 80 adjacent to the flange 50. The bellows segment 80 is partly ornamental, yet it also functions to assist the user in centering the flange 50 on the bottle rim 26 prior to bottle lid 30 fastening.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A dispenser adaptor for a nursing bottle containing liquid having a bottle bottom wall joined to a tubular bottle side wall with an rim onto which is removably fitted a bottle lid having an outwardly protruding nipple structure containing a liquid passageway, said bottle lid being fastened against said upper rim and said side wall with fastening means, said adaptor comprising:

a substantially disk-shaped flange having a central port, for placement onto said upper rim when said lid is removed, and for securing within said bottle by fastening said lid onto said rim within said fastening means such that said flange is retained between said lid and said rim, said flange making sealing contact with said nipple structure circumscribing said liquid passageway, and a liquid gathering tube extending from said central port in said flange toward said bottle bottom wall and opening within said bottle to gather said liquid, such that drawing upon said nipple structure extracts a quantity of said liquid through said liquid gathering tube and said nipple structure and from said bottle, wherein said liquid gathering tube comprises an expanded segment adjacent to and below said flange having substantially the configuration of a bellows, said expanded segment having an outer diameter substantially larger than the diameter of the remainder of said liquid gathering tube for assisting the user in centering said liquid gathering tube within said bottle side wall and thereby centering said flange on said bottle rim for placement of said bottle lid.

2. The adaptor of claim 1, wherein said flange has an upper surface and wherein an annular central region of said upper surface protrudes upwardly around said central port to make sealing contact with said nipple structure, such that suction created by a child drawing upon the nipple structure is transmitted into said liquid gathering tube to draw said liquid through said liquid gathering tube into said nipple structure.

3. The adaptor of claim 1, wherein said nursing bottle is the wider of two said nursing bottles, wherein said adaptor has an outer diameter equal to the outer diameter of the rim of the wider of said two nursing bottles, and wherein said adaptor is adaptable to fit the diameter of the rim of the narrower of said two nursing bottles, said adaptor comprising a stress rising groove extending along a circular groove path around and spaced outwardly from said central port to define a flange outer portion, wherein the diameter of said groove path matches the outer rim diameter of the narrower nursing bottle, such that said groove severs by tearing by a user for removal of said flange outer portion beyond said groove to leave said flange with a smaller diameter matching the outer diameter of the rim of the narrower bottle.

* * * * *